United States Patent [19]

Schmitz

[11] Patent Number: 4,596,421

[45] Date of Patent: Jun. 24, 1986

[54] OFFICE CHAIR

[76] Inventor: Pierre Schmitz, Ginsterweg 29, 5657 Haan, Fed. Rep. of Germany

[21] Appl. No.: 573,032

[22] Filed: Jan. 23, 1984

[30] Foreign Application Priority Data

Jan. 21, 1983 [DE] Fed. Rep. of Germany ..... 3301900

[51] Int. Cl.[4] ..... A47C 1/02

[52] U.S. Cl. ..... 297/316; 297/301; 297/353

[58] Field of Search ..... 297/300, 301, 316, 304, 297/83

[56] References Cited

U.S. PATENT DOCUMENTS

| | | | |
|---|---|---|---|
| 1,909,018 | 5/1933 | Sengpiel | 297/301 |
| 2,374,350 | 4/1945 | Herold | 297/301 |
| 2,615,496 | 10/1952 | Lorenz et al. | 297/300 X |
| 2,859,799 | 11/1958 | Moore | 297/316 X |
| 3,455,601 | 7/1969 | Lie | 297/301 |
| 4,270,797 | 6/1981 | Bräuning | 297/316 X |
| 4,432,582 | 2/1984 | Wiesmann et al. | 297/353 X |

*Primary Examiner*—William E. Lyddane
*Assistant Examiner*—Peter A. Aschenbrenner
*Attorney, Agent, or Firm*—Michael J. Striker

[57] ABSTRACT

An office chair includes a seat portion pivotable about one horizontal axis relative to a vertical stand and a back rest portion pivotable about another horizontal axis relative to the vertical stand of the chair, upon the application of the weight of the seated person onto the seat portion. The seat portion and the back rest portion are coupled to each other by a coupling lever and a holding element for holding the back rest portion so that when the seat portion is inclined forwardly the back rest portion is also inclined forwardly and when the seat portion is inclined rearwardly the back rest portion follows this motion of the seat portion.

23 Claims, 8 Drawing Figures

OFFICE CHAIR

BACKGROUND OF THE INVENTION

The present invention pertains to a chair, and to an office chair in particular.

Office chairs of the type under consideration include a vertical stand, provided with a plurality of radially outwardly extended feet having at the ends thereof rollers, a seat portion on that vertical stand and a back rest portion. The seat portion and the back rest portion are pivotable so that the chair, under the weight of the user can be adjusted to the posture of the user's body. The seat portion can be vertically adjustable.

In such known office chairs the inclination of the seat portion is mechanically adjustable. In order to adjust the seat portion to any desired inclined position one should loose the fastening means, adjust the angle of inclination of the seat portion and fasten the fastening means again. The same means can be applied to the adjustment of the back rest portion to any desired inclined position. Since such an adjustment is rather bothersome frequently in practice desired inclined positions of the seat portion and back rest portion are first preadjusted and then additionally modified.

With known office chairs the back rest portion is normally not-adjustable in respect to the seat portion and the back rest portion is pivotable rearwardly together with the seat portion. Such a combined pivoting motion of the back rest portion and the seat portion is usually performed against the force of a spring, which force is adjustable.

SUMMARY OF THE INVENTION

It is an object of the present invention to provide an improved office chair.

It is another object of this invention to provide an office chair in which the disadvantages of conventional office chairs would be avoided and in which the adjustment of the inclined position of the seat portion would cause a simultaneous adjustment of the inclined position of the back rest portion under the weight of the seated person.

These and other objects of the invention are attained by a chair, particularly for use as an office chair, having a front side and a rear side and comprising a vertical stand frame provided with feet radially outwardly extended therefrom and each terminated with a roll; a supporting stand element mounted in said stand frame and vertically adjustable relative thereto; a supporting plate rigidly connected to said supporting stand element; a seat portion positioned above said supporting plate, said seat portion being under the weight of a user pivotable within certain limits about a first pivot axis which extends horizontally and parallely to said front side to adjust the seat portion in inclined positions; a back rest portion pivotable within certain limits about a second pivot axis which extends horizontally and parallely to said rear side to adjust said back rest portion in inclined positions; and coupling means for coupling said pivotable seat portion to said pivotable back rest portion so that during the inclination of said seat portion forwardly said back rest portion pivots forwardly and during the inclination of said seat portion rearwardly said back rest portion pivots rearwardly.

Thereby, according to the invention upon the adjustment of the position of the seat portion under the weight of a seated person a simultaneous modification of the position of the back rest portion takes place, the back rest portion being pivotable relative to the supporting plate attached to the vertical chair stand.

According to a further feature of the present invention the inclination of the back rest portion follows the inclination of the seat portion with a predetermined transmission ratio.

The pivoting angle of inclination of the back rest portion is greater than the pivoting angle of inclination of the seat portion. Thus the back rest portion takes a position adjusted to the body of the seated person in the advantageous manner.

According to still another feature of the invention the above mentioned ratio may be about 2 to 3. It can be achieved thereby than if the seat portion is inclined at the angle of about 2° the back rest portion is inclined at the angle of about 3° relative to their initial straight positions.

According to a further feature of the invention the coupling means may include a coupling lever interconnected between said seat portion and said back rest portion.

The chair may further include a holding frame positioned below said seat portion and rigidly connected thereto, said coupling lever having one end pivotally connected to said holding frame, said first pivot axis extending through said supporting plate and being supported in said holding frame.

The coupling means may further include a back rest holding member connected to said back rest portion, said coupling lever having another end pivotally connected to the back rest holding member.

The holding frame may have a rod-like element extended downwardly therefrom and approximately normally to a plane of the seat portion, said one end of said coupling lever being pivotally connected to the rod-like element.

Therefore a four-link hinge or pivot arrangement, in a very simple fashion provides the transmission of the pivoting motion of the seat portion into the pivoting motion of the back rest portion.

According to a still another feature of the invention the second pivot axis may extend through said supporting plate and be supported in said back rest holding member.

The first pivot axis and the second pivot axis may extend parallel to each other and in the same horizontal plane. The supporting stand element may be connected to said supporting plate before said first and second pivot axis as seen in the direction from the front side of the chair to the rear side of the chair. Therefore the pivoting or inclination of the seat portion takes place about the axis which is parallel to that axis about which the pivoting or inclination of the rest back portion is carried out.

The chair may further include a third pivot axis, at which said one end of said coupling lever is pivotally connected to said rod-like element, and a forth pivot axis at which another end of said coupling lever is pivotally connected to said back rest holding member, and wherein the distance between said first pivot axis and said third pivot axis on said rod-like element is greater than the distance between said second pivot axis and said fourth pivot axis on said back rest holding member. Thereby an increased or amplified pivoting motion of the back rest portion relative to the pivoting of the seat portion can be obtained.

The ratio of the distance between the first pivot axis and the third pivot axis to the distance between the second pivot axis and the fourth pivot axis may be about 3 to 2. Due to a longer path of the lever it will be obtained, that upon the pivoting or inclination of the seat portion about the angle of 2°, the pivoting or inclination of the back rest portion about the angle of 3° will be produced.

The holding frame may include two lateral parallel bars spaced from each and extended at two lateral sides of the chair, and a transverse bar connecting said lateral bars to each other and extended beyond them along the front side of the chair, said supporting plate being positioned between said lateral spaced bars. The bars of the holding frame may be fabricated from aluminum cast and connected to each other by welding.

The chair may further include fastening means for connecting the holding frame to the seat portion, said lateral bars being formed with openings through which said fastening means extend into the seat portion. These fastening means may be bolts.

The holding frame may be pivotable between one end position and another end position, and may include a first stop member which is engaged with a surface of said supporting plate at a front side thereof when said holding frame is in one end position, and a second stop member mounted to said lateral bars and engaging with a surface of said supporting plate at a rear side thereof when said holding frame is in another end position. These two stop members limit the pivoting motion of the seat portion within certain range; thus the simultaneous pivoting of the back rest portion is also limited. Due to the provision of these two stop members the pivoting motion stops when the supporting plate comes into contact with the respective stop member.

The holding frame may further include two opposing tubular bearing elements which support the first pivot axis.

Furthermore, the holding frame may include reinforcing plates on the tubular bearing elements and roller bearings positioned in the tubular bearing elements, said first pivot axis having two opposite end portions engaged in the roller bearings. Thereby a light but yet reliable support of the seat portion on the supporting plate is provided, and reinforcing plates provide for required rigidity.

One of said reinforcing plates may be elongated and form said rod-like element to which the coupling lever is pivotally connected. Thus the rod-like element supporting the pivot means simultaneously has the function of the reinforcing means.

The first pivot axis, at which said holding frame and said supporting plate are pivotable relative to each other, may be held in the supporting plate against rotation and against axial displacement. Thereby, the first pivot axis is held in a simple fashion on the supporting plate so that the holding frame with the seat portion can pivot about the rotation-fixed axle.

The first pivot axis may have a flattened portion in the region of said supporting plate, said supporting plate having a bore, and a bolt may be provided, which extends through said bore and abuts against the flattened portion to prevent the first pivot axis from rotation and axial displacement in the supporting plate.

The third pivot axis may be formed by a sleeve extended through said rod-like element and said coupling lever, and a bolt mounted in said sleeve, and a nut and washers may be provided to secure said bolt in said sleeve. A pivot connection between the coupling lever and the rod-like element is thus provided in a simple fashion.

The fourth pivot axis may be a pin having two ends and an intermediate portion, said back rest holding member carrying two bronze bearings in which said two ends are engaged, said coupling lever carrying another bronze bearing in which said intermediate portion is engaged.

The hinge arrangement of the chair may further include caps, the ends of said pin having annular grooves, said caps having projections engaged in said annular grooves and being positioned externally of said back rest holding member, said caps securing said fourth pivot axis against axial displacement. The aforementioned caps in addition improve an outer appearance of the hinge arrangement of the chair.

The back rest holding member may have two lateral walls spaced from each other and supporting said two bronze bearings, said second pivot axis being a pin having two opposite ends supported in said lateral walls and provided with caps positioned externally of said lateral walls and securing said second pivot axis against axial displacement. Thereby a pivot connection between the supporting plate and the back rest portion is provided in a very simple manner.

The supporting plate may include an inner tubular portion open towards the seat portion, and a helical compression spring mounted in said inner tubular portion, the compression spring having one end supported against an inner wall of the supporting plate and another end supported against said second stop member. This spring serves for returning the seat portion and the back rest portion to the initial straight positions. The force of this spring must be sufficiently large to make such a returning motion possible. The inclination of the seat portion upon the application of the weight of the seated person to that seat portion takes place against the force of that compression spring. This spring, however should not affect the adjustment of the chair.

According to yet further feature of the invention the chair may include an elongated rod connected to said back rest portion, said back rest holding member having a bore partially receiving said elongated rod, and wherein an actuating handle is provided connected to said rod to vertically adjust the latter in various positions. The actuating handle can also lock the elongated rod in any adjusted position.

The elongated rod may be pivotally connected to the back rest portion.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 3:
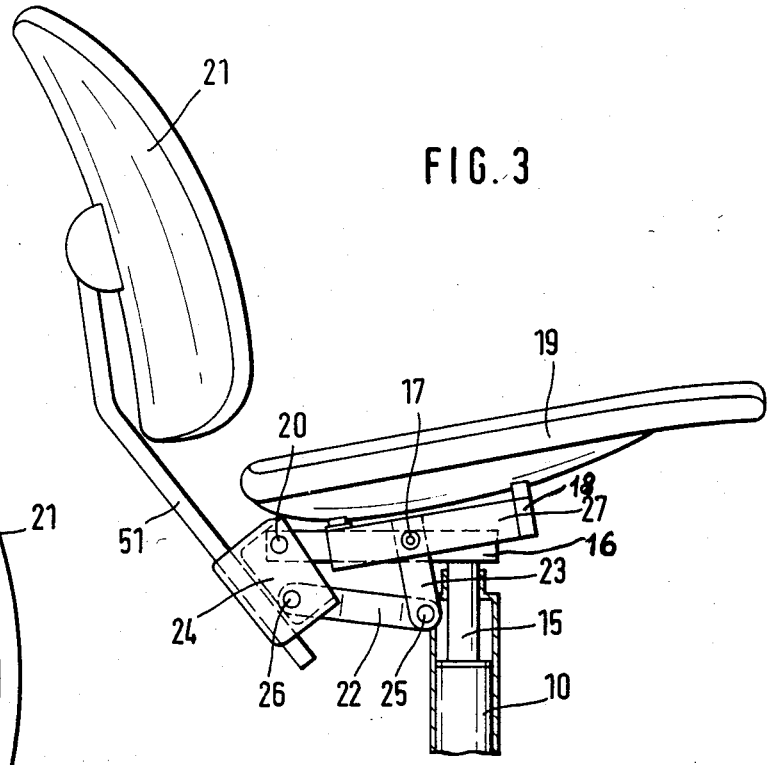
FIG. 3 is a partial side view corresponding to that of FIG. 2 but with the back rest and seat hinged rearwardly.
Figure 2:
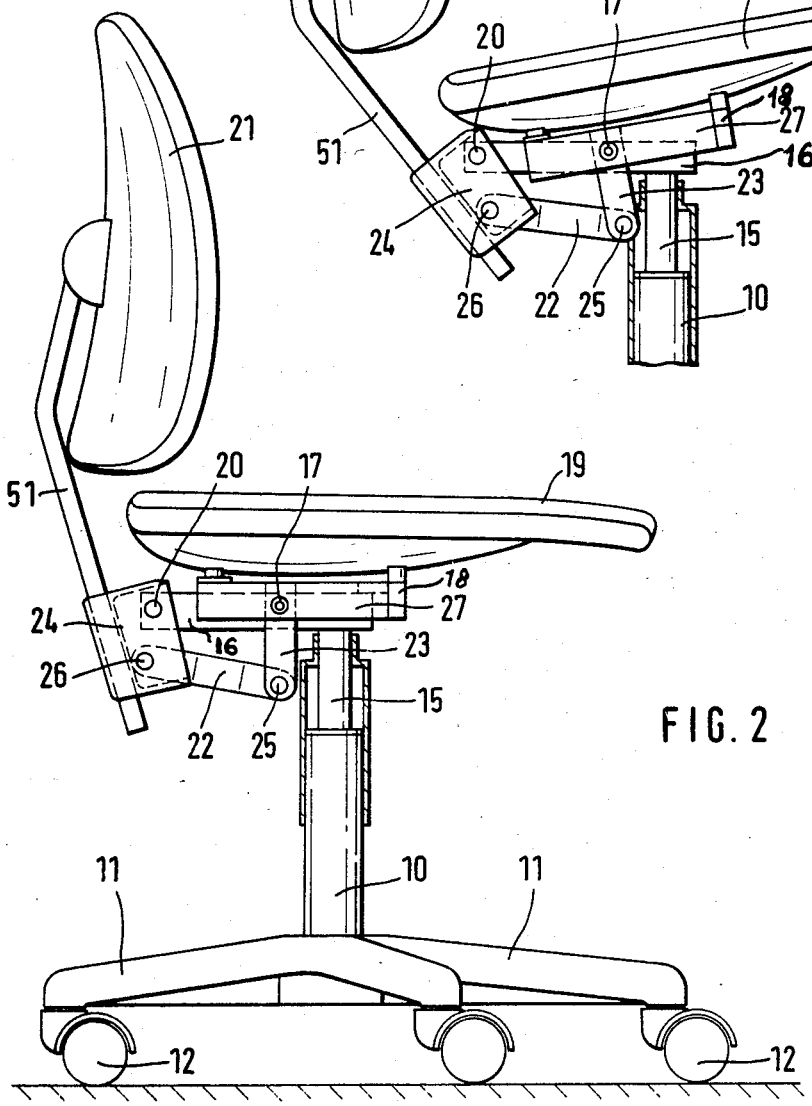
FIG. 2 is a side view of the office chair shown in FIG. 1.

Referring now to the drawings in detail, the office chair is comprised of an elongated frame 10 which is substantially cylindrical and is provided with radially outwardly extended feet 11 which have at the free ends thereof rolls 12 in the known fashion. A gas spring 13 is mounted in the interior of foot frame 10, which surrounds a supporting stand 15, the latter being vertically adjusted by means of gas spring 13 and by actuating of an actuating lever 14 in the known manner. A carrying or supporting plate 16 is rigidly connected, for example by welding or any other suitable means, to the upper end of supporting stand 15 as shown in FIGS. 2 and 3.

Figure 8:
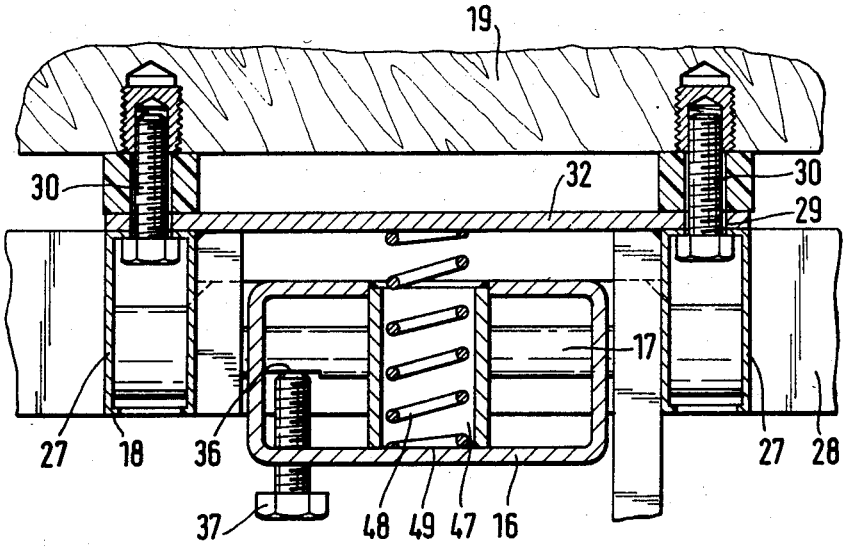
FIG. 8 is a sectional view taken along line VIII—VIII of FIG. 5, on the enlarged scale.

Supporting plate 16, as seen from FIG. 8, is a hollow rectangular frame. A holding frame 18 is hingedly or pivotally supported on a pivot axle 17 which extends horizontally and parallely to the front side of the chair and mounted on the supporting plate 16 so that holding frame 18 can pivot in respect to supporting plate 16. A seat portion 19 is connected to the holding frame 18 to pivot therewith. Furthermore, a back rest 21 is pivotally supported on a second pivot axle 20 mounted in the supporting plate 16 and extended parallel to the back side of the chair so that the back rest 21 can pivot relative to supporting plate 16.

The seat portion 19, which is inclinable or pivotable about the pivot axle 17 parallel to the front side of the chair under the weight of a user, is coupled with the back rest 21, which is inclinable or pivotable about the second pivot axle 20 parallel to the rear side of the chair, by means of a coupling lever 22 so that when the seat portion 19 is inclined forwardly the back rest 21 is also eventually inclined forwardly and when the seat portion 19 is pivoted rearwardly the back rest also swings rearwardly. Thus the movement of the back rest follows the movement of the seat portion with a predetermined transmission ratio. This means that when the seat portion 19 is inclined the inclination of the back rest with a greater pivot angle follows. The transmission ratio of these movements can amount to about 2–3. This is obtained in such a simple fashion that if the seat portion 19 is pivoted under the weight of the user the back rest 21 remains in position against the back of the user even when he or she leans forwardly or rearwardly.

FIGS. 4 to 8 illustrate a hinge assembly or arrangement of the office chair according to the invention. The coupling lever 22 is at one end thereof pivotally connected to the free end of a bar 23 by means of pivot axle 25 and at the other end thereof is pivotally connected to a back rest holding member 24 by means of a pivot axle 26. Bar or rod 23 is rigidly connected to the holding frame 18 situated below the seat portion 19, bar 3 estending downwardly from the plane of the seat portion and somewhat perpendicularly thereto and being connected to the holding frame 28.

Both pivot axles 17 and 20 of the seat portion 19 are parallel to each other and extend approximately in one horizontal plane. Axle 17 extends through supporting plate 16 and holding frame 18 while axle 20 extends through the holding frame 18 and back rest holding member 24; the supporting stand 15 of the foot frame 10 being attached to supporting plate 16 before pivot axles 17 and 20. Thereby an approximately centrally arranged supporting of the seat portion 19 is obtained so that desired pivoting motions of the seat portion 19 and back rest 21 under the weight of the user can be carried out.

Bar 23, as mentioned above is rigidly connected to holding frame 18 of the seat portion 19. The distance between axle 17 of the seat portion 19 and a pivot axle 25 of the coupling lever 22 is greater than the distance between pivot axle 20 of the back rest 21 and pivot axle 26 of the coupling lever 22, positioned on the back rest holding member 24. The ratio between these distances is from 2 to 3 so that the pivoting motion of the back rest 21 at a greater angle is obtained when the seat portion is swung.

Figure 4:
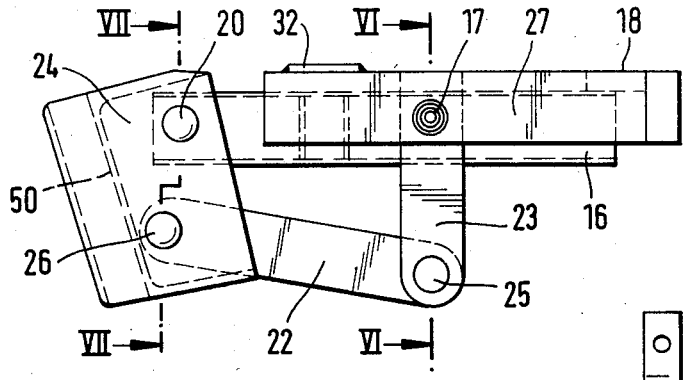
FIG. 4 is a side view of the hinge arrangement of the office chair.
Figure 5:
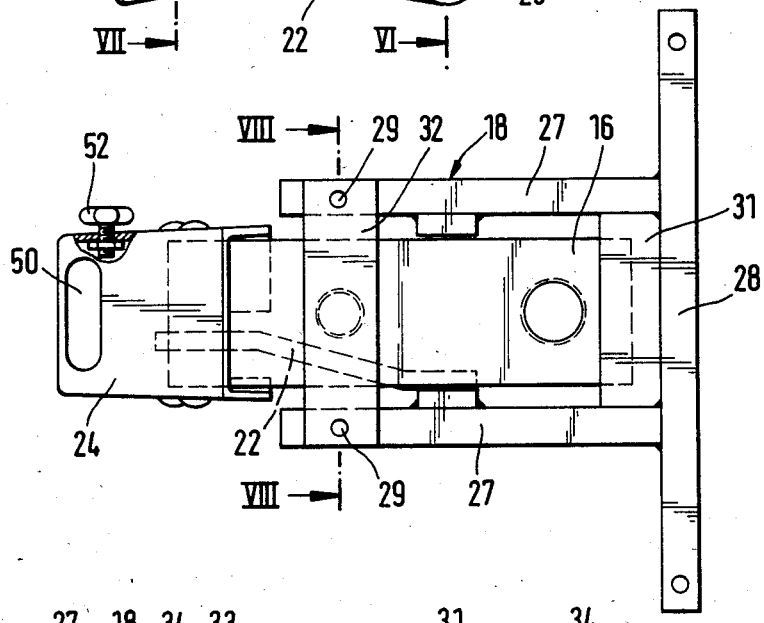
FIG. 5 is a top plan view of the hinge arrangement.

As seen from FIGS. 4 and 5 in particular, holding frame 18 attached to the underside of seat portion 19 is formed of two parallel frame bars or rods 27 which extend also parallel to the lateral sides of the chair, and an elongated transverse bar or rod 28 rigidly connected, for example by welding, to the front ends of bars 27. Transverse bar 28 is located on the front side of the chair as seen from FIG. 1. The end portions of the front bar 28 extend beyond parallel bars 27. Supporting plate 16 is disposed between two parallel bars 27 of holding frame 18. Perforations or openings 29 are provided in two parallel bars 27, which receive fastening bolts 30 which serve the purpose of connecting the holding frame 18 to the underside of the seat portion 19 as seen from FIG. 8.

The holding frame 18 connected to seat portion 19 and pivotable about axle 17 relative to supporting plate 16, held on the supporting stand 15 of frame 10, swings within certain limits, e.g. between two end positions. In one end position of the holding frame a stop bar 31 connected to the front bar 28 of the holding frame abuts against the upper side of the front end portion of plate 16 as seen from FIG. 6. In another end position of holding frame 18, another stop element, e.g. stop plate 32, supported on two ends of frame bars 27 and connected to those bars by bolts 30 mentioned above and shown in FIG. 8, abuts against the upper side of the rear end portion of supporting plate 16. Thereby, the limits of the swinging motion of the seat portion 19 and back rest 21 therewith are obtained in a simple fashion.

Figure 6:
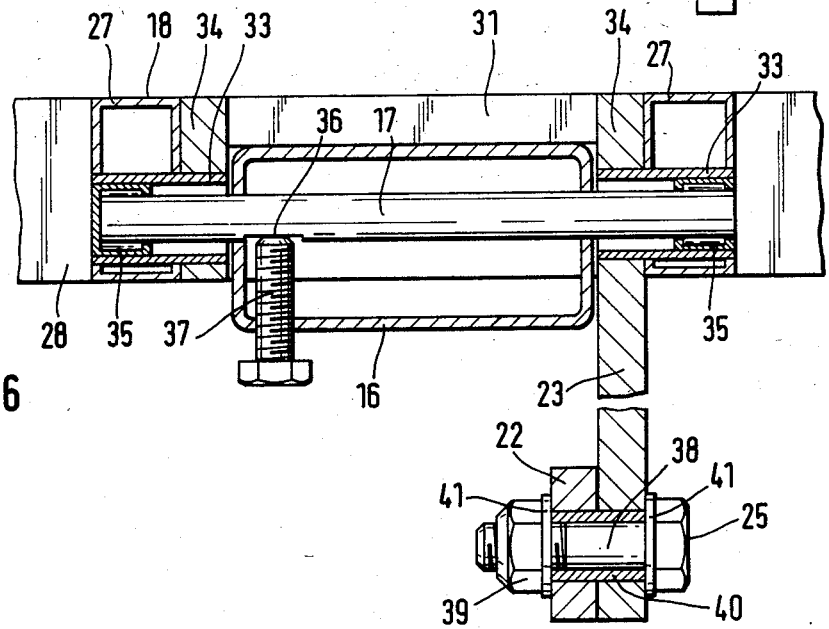
FIG. 6 is a sectional view taken along line VI—VI of FIG. 4, on the enlarged scale.

With reference to FIG. 6 it will be seen that both lateral frame bars 27 of the holding frame 18 have tubular bearing portions 33 for receiving opposite ends of pivot axle 17. Bars 27 are further provided with reinforcing plates 34 rigidly connected thereto at the sides of bars 27 facing towards each other as seen from FIG. 6. The end portions of pivot axle 17 are supported in bevel roller bearings 35 disposed in tubular bearing members 33 of holding frame 18. Thereby a light but sufficient supporting of the pivot axle 17 in the tubular bearing members 33 is obtained so that axle 17 is reliably supported in holding frame 18 and can take up a required loading. The holding frame 18, fastened to the seat portion 19 and pivotable relative to the plate 16 supported on the stand 15 of the foot frame 10, is rotation-fixed and is reliably held in plate 16 against displacement in the axial direction. For this purpose has the pivot axle 17, extended through the supporting plate 16, a flattening which forms an abutment 36 against which the free end of a bolt 37, inserted into a respective threaded opening provided in supporting plate 16, bears. Upon the insertion of bolt 37 axle 17 is reliably secured against rotation, and the axial displacement of axle 17 relative to plate 16 is also prevented.

One of reinforcement plates 34 provided on lateral tubular bars 27 of the holding frame 28 has an extension projected in the downward direction, that extension forming the abovementioned bar 23 which is pivotally connected to the coupling lever 22. Bar or rod 23 thereby is merely formed as a part of the reinforcement plate 34 in a very simple fashion.

As seen in FIG. 6, pivot axle 25 is formed by a sleeve 40 which projects through the bar 23 and coupling lever 22. Nut 39 and washers 41 secure bolt 38 extended through sleeve 40 on the opposite sides of the coupling lever 22 and bar 23, the latter as mentioned above being fixed to the holding frame 18 of the seat portion 19. Thereby a pivot connection between the coupling lever and bar 23 is also provided in a very simple fashion.

Figure 7:
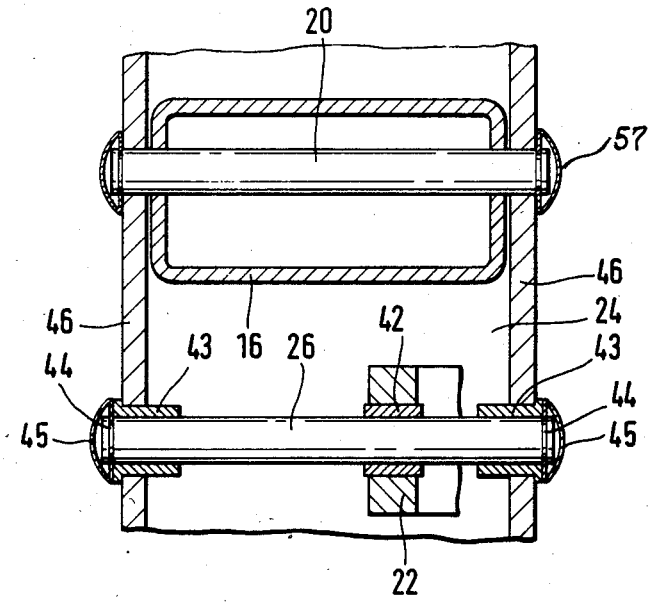
FIG. 7 is a sectional view taken along line VII—VII of FIG. 4, on the enlarged scale.

The pivot axle or pin 26 between the coupling lever 22 and back rest holding member 24 extends through a bronze bearing 42 disposed in the coupling lever 22 as shown in FIG. 7. Two opposite end portions of axle 26 are engaged in bronze bearings 43, which are in turn supported in the respective openings formed in lateral walls 46 of the back rest holding member 24. Thereby the pivot axle 26 is reliably supported in coupling lever 22 and back rest holding member 24. Axle 26 has at two ends thereof, extended outwardly from the respective bearings 43 annular grooves 44 which receive respective holding annular projections of caps 45. The latter secure pivot axle 26 against axial displacement.

As can be also seen from FIG. 7 the second pivot axle 20, extended through the respective openings provided in the supporting plate 16 and the openings formed in lateral wall 46 of the back rest holding member 24, is secured against axial displacement by means of caps 57 in the fashion similar to that for axle 26. The back rest holding member 24 is thereby reliably pivotally supported on plate 16.

Figure 1:
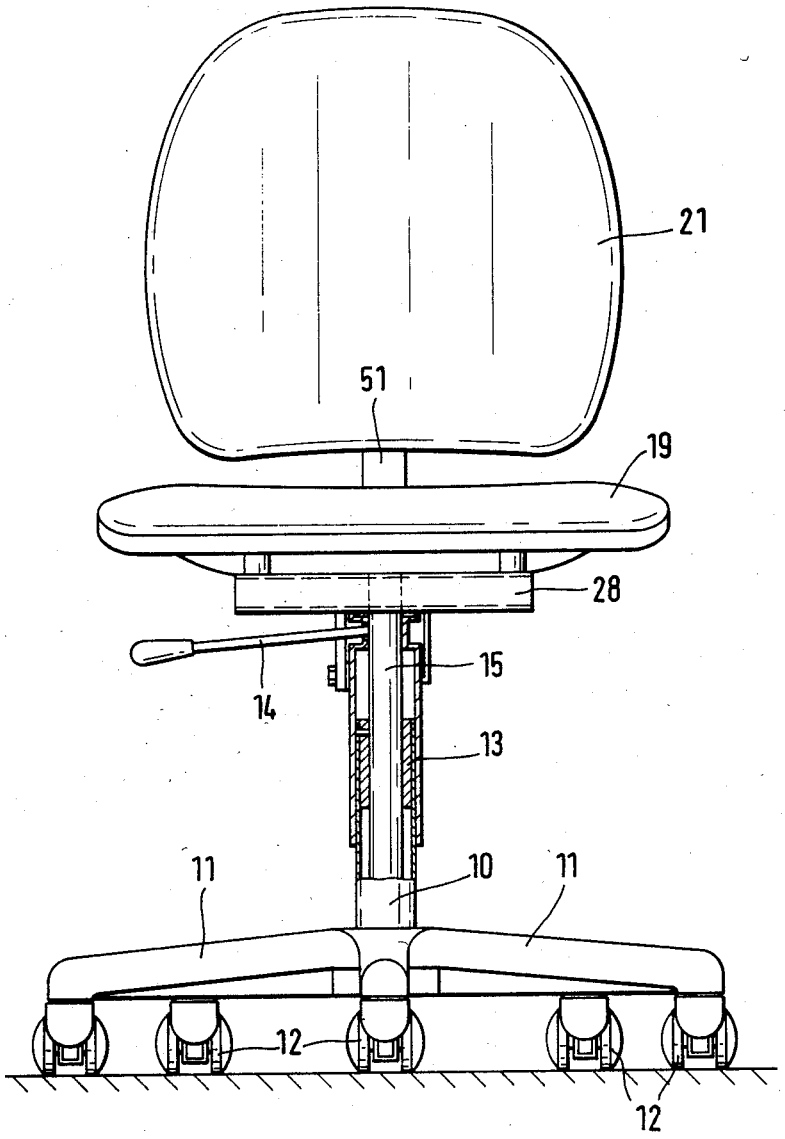
FIG. 1 is a front view, partially in section of the office chair according to the invention.

Supporting plate 16 has, as can be seen from FIG. 8, a tubular portion 47 open upwardly and adapted to receive a helical compression spring 48, one end of which bears against the bottom 49 of tubular portion 47 and the other end of which is supported against the stop plate 32 provided on the upper side of holding frame 18. Compression spring 48 ensures a reverse motion of the seat portion 19 and back rest 21 to the base position when the user frees the office chair. The base position of the office chair according to the invention is illustrated in FIGS. 1 and 2. Helical compression spring 48 is made relatively weak but the force of this spring is sufficient to return seat portion 19 and back rest 21 to the base or initial position. Compression spring 48 should, during the reclining of the seat portion 19 and back rest 21 rearwardly, apply to the seat portion the least possible resistance to that reclining motion.

As seen from FIGS. 4 and 5, back rest holding member 24 has a bore 50, extended somewhat vertical, in which the end portion of an elongated rod 51, seen in FIG. 2, is received. Another end of rod 51 is connected to back rest 21. An actuating handle 52 connected to rod 51 serves for securing rod 51 in various positions in the known fashion. The back rest 21 can, with the aid of handle 52 and rod 51, be adjusted vertically.

It will be understood that each of the elements described above, or two or more together, may also find a useful application in other types of chairs differing from the types described above.

While the invention has been illustrated and described as embodied in an office chair, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A chair, particularly for use as an office chair, comprising a vertical stand provided with feet radially outwardly extended therefrom and each having at a lower end a roller; a stand-supporting element mounted in said stand and vertically adjustable relative thereto; a supporting frame rigidly connected to said stand-supporting element; a seat portion having a front end defining a front side of the chair and positioned above said supporting frame; a holding frame positioned below said seat portion and rigidly connected thereto and including a first pivot pin which extends through said supporting frame so that said seat portion under the weight of a user is pivotable within certain limits about said first pivot pin which extends horizontally and parallel to said front side to adjust the seat portion in inclined postions; a back rest portion defining a rear side of the chair; and coupling means for coupling said seat portion to said back rest portion and including a back rest holding member connected to said back rest portion and including a second pivot pin which extends through said supporting frame horizontally and parallel to said rear side, and a coupling member pivotally connected at one end thereof with said holding frame and pivotally connected at the other end thereof with said back rest holding member, said back rest portion being pivotable within certain limits about said second pivot pin to adjust said back rest portion in inclined positions, whereby during the inclination of said seat portion forwardly said back rest portion automatically pivots forwardly and during the inclination of said seat portion rearwardly said back rest portion automatically pivots rearwardly under the weight of a user only.

2. The chair as defined in claim 1, wherein the ratio between the inclination of said back rest portion which follows said seat portion and the inclination of said seat portion is predetermined.

3. The chair as defined in claim 2, wherein said ratio is from about 2 to 3.

4. The chair as defined in claim 1, wherein said holding frame has a rod-like element extended downwardly therefrom and approximately normally to a plane of said seat portion, said one end of said coupling member being pivotally connected to said rod-like element.

5. The chair as defined in claim 1, wherein said first pivot pin and said second pivot pin extend parallel to each other and in the same horizontal plane.

6. The chair as defined in claim 5, wherein said stand supporting element is connected to said supporting frame before said first and second pivot pin as seen in the direction from said front side to said rear side.

7. The chair as defined in claim 5, further including a third pivot pin, pivotally connecting said one end of said coupling member to said rod-like element, and a forth pivot pin pivotally connecting the other end of said coupling member to said back rest holding member, and wherein the distance between said first pivot pin and said third pivot pin on said rod-like element is greater than the distance between said second pivot pin and said fourth pivot pin on said back rest holding member.

8. The chair as defined in claim 7, wherein the ratio of the distance between said first pivot pin and said third pivot pin to the distance between said second pivot pin and said fourth pivot pin is about 3 to 2.

9. The chair as defined in claim 7, wherein said holding frame includes two lateral parallel bars positioned at two lateral sides of the chair and a transverse bar connecting said lateral bars to each other and extended beyond them along the front side of the chair, said supporting plate being positioned between said lateral spaced bars.

10. The chair as defined in claim 9, further including fastening means for connecting said holding frame to said seat portion, said lateral bars being formed with openings through which said fastening means extend into said seat portion.

11. The chair as defined in claim 10, wherein said fastening means are bolts.

12. The chair as defined in claim 9, wherein said holding frame is pivotable between one end position and the other end position, said holding frame including a first stop member which is engaged with a surface of said supporting frame at a front side thereof when said holding frame is in one end position, and a second stop member mounted to said lateral bars and engaging with a surface of said supporting frame at a rear side thereof when said holding frame is in the other end position.

13. The chair as defined in claim 12, wherein said holding frame further includes two opposing tubular bearing elements which support said first pivot pin.

14. The chair as defined in claim 13, wherein said holding frame further includes reinforcing plates on said tubular bearing elements and roller bearings positioned in said tubular bearing elements, said first pivot pin having two opposite end portions engaged in said roller bearings.

15. The chair as defined in claim 14, wherein one of said reinforcing plates is elongated and forming said rod-like element to which said coupling member is pivotally connected.

16. The chair as defined in claim 15, wherein said first pivot pin, at which said holding frame and said supporting frame are pivotable relative to each other, is held in said supporting frame against rotation and against axial displacement.

17. The chair as defined in claim 16, wherein said first pivot pin has a flattened portion in the region of said supporting frame, said supporting frame having a bore, and wherein a bolt is provided, which extends through said bore and abuts against said flattened portion to prevent said first pivot pin from rotation and axial displacement in said supporting frame.

18. The chair as defined in claim 15, wherein said third pivot pin is formed by a sleeve extended through said rod-like element and said coupling member, and a bolt mounted in said sleeve, and wherein a nut and washers are provided to secure said bolt in said sleeve.

19. The chair as defined in claim 15, wherein said fourth pin has two ends and an intermediate portion, said back rest holding member carrying two bronze bearings in which said two ends are engaged, said coupling member carrying another bronze bearing in which said intermediate portion is engaged.

20. The chair as defined in claim 19, further including caps, said fourth ends of said pin having annular grooves, said caps having projections engaged in said annular grooves and being positioned externally of said back rest holding member, said caps securing said fourth pivot pin against axial displacement.

21. The chair as defined in claim 20, wherein said back rest holding member has two lateral walls spaced from each other and supporting said two bronze bearings, said second pivot pin having two opposite ends supported in said lateral walls and provided with caps postioned externally of said lateral walls and securing said second pivot pin against axial displacement.

22. The chair as defined in claim 15, wherein said supporting frame includes an inner tubular portion open towards said seat portion, and a helical compression spring mounted in said inner tubular portion, said compression spring having one end supported against an inner wall of said supporting frame and the other end supported against said second stop member.

23. The chair as defined in claim 15, further including an elongated rod connected to said back rest portion, said back rest holding member having a bore partially receiving said elongated rod, and wherein an actuating handle is provided, connected to said rod to vertically adjust the latter in various positions.

* * * * *